US008955958B2

(12) United States Patent
Itogawa

(10) Patent No.: US 8,955,958 B2
(45) Date of Patent: Feb. 17, 2015

(54) LIQUID EJECTION APPARATUS AND METHOD OF DRYING RECORDING MEDIUM FOR THE SAME

(71) Applicant: Brother Kogyo Kabushiki Kaisha, Nagoya-shi, Aichi-ken (JP)

(72) Inventor: Yoshihiro Itogawa, Mizuho (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/850,990

(22) Filed: Mar. 26, 2013

(65) Prior Publication Data

US 2013/0257959 A1 Oct. 3, 2013

(30) Foreign Application Priority Data

Mar. 30, 2012 (JP) ..... 2012-080100

(51) Int. Cl.
*B41J 2/01* (2006.01)

(52) U.S. Cl.
USPC ..... 347/102; 347/16; 347/105

(58) Field of Classification Search
USPC ..... 347/5, 9, 16, 102, 105
See application file for complete search history.

(56) References Cited

U.S. PATENT DOCUMENTS

| | | | | |
|---|---|---|---|---|
| 5,373,312 | A | 12/1994 | Fujioka et al. | |
| 5,530,466 | A | 6/1996 | Fujioka et al. | |
| 5,646,653 | A | 7/1997 | Fujioka et al. | |
| 5,646,668 | A | 7/1997 | Fujioka et al. | |
| 6,217,168 | B1 * | 4/2001 | Elgee | 347/105 |
| 2002/0196300 | A1 | 12/2002 | Takahashi et al. | |
| 2003/0234847 | A1 * | 12/2003 | Takekoshi et al. | 347/102 |
| 2011/0199448 | A1 * | 8/2011 | Kaiho et al. | 347/102 |
| 2012/0026264 | A1 * | 2/2012 | Ikoshi | 347/102 |

FOREIGN PATENT DOCUMENTS

| | | | |
|---|---|---|---|
| JP | H03-173647 | A | 7/1991 |
| JP | 2002-274740 | A | 9/2002 |
| JP | 2002-337319 | A | 11/2002 |
| JP | 2004-130565 | A | 4/2004 |

* cited by examiner

*Primary Examiner* — Lam S Nguyen
(74) *Attorney, Agent, or Firm* — Merchant & Gould PC

(57) ABSTRACT

A liquid ejection apparatus includes: a liquid ejection head that ejects a liquid onto a recording medium; a drying device that dries the recording medium; a sheet discharged tray including a sheet placed face; a sheet discharging device that discharges the recording medium to a space over the sheet placed face; a stopper that causes the recording medium discharged by the sheet discharging device to collide with the stopper; an obtaining device that obtains a height of the plurality of recording media stacked on the sheet placed face; and a controller that controls the drying device so that a degree of drying of the recording medium becomes larger in a case in which the height obtained by the obtaining device is equal to or more than a set specific value, than in a case in which the height is less than the set specific value.

10 Claims, 16 Drawing Sheets

STACK HEIGHT THRESHOLD

| STACK HEIGHT | HEATING TIME |
|---|---|
| 1cm | 0.5 sec (T) |
| 2cm | 0.5 sec (T) |
| ⋮ | ⋮ |
| 5cm | 0.6 sec |
| 6cm | 0.8 sec |
| 7cm | 1.2 sec |
| ⋮ | ⋮ |

FIG.9

| | T1 FIRST TABLE | T2 SECOND TABLE |
|---|---|---|
| STACK HEIGHT | HEATING TIME | HEATING TIME |
| 1cm | 0.5 sec | 0.7 sec |
| 2cm | 0.5 sec | 0.7 sec |
| ⋮ | ⋮ | ⋮ |
| 5cm | 0.6 sec | 0.8 sec |
| 6cm | 0.8 sec | 1.0 sec |
| 7cm | 1.2 sec | 1.4 sec |
| ⋮ | ⋮ | ⋮ |

FIG.14

T7

| STACK HEIGHT | MOTOR VOLTAGE |
|---|---|
| 1cm | 5V |
| 2cm | 5V |
| ⋮ | ⋮ |
| 5cm | 6V |
| 6cm | 8V |
| 7cm | 12V |
| ⋮ | ⋮ |

STACK HEIGHT THRESHOLD → 5cm

LIQUID EJECTION APPARATUS AND METHOD OF DRYING RECORDING MEDIUM FOR THE SAME

CROSS REFERENCE TO RELATED APPLICATION

The present application claims priority from Japanese Patent Application No. 2012-080100, which was filed on Mar. 30, 2012, the disclosure of which is herein incorporated by reference in its entirety.

BACKGROUND OF THE INVENTION

1. Field of the Invention

The present invention relates to a liquid ejection apparatus which ejects a liquid, such as an ink, onto a sheet-like recording medium and then discharges the recording medium. The present invention also relates to a method of drying a recording medium for the liquid ejection apparatus.

2. Description of Related Art

There is known, as one of the liquid ejection apparatuses, an ink-jet recording apparatus which ejects an ink onto a sheet-like recording medium, such as a paper sheet and a film sheet, so as to record an image on the recording medium. The ink jet recording apparatus is typically configured to feed a recording medium from the sheet supply tray, eject a liquid such as an ink onto the recording medium with a head so as to perform a printing, and then discharge the printed recording medium to a sheet discharged tray.

Recently, there is a request for performing the printing in a high speed. However, where the printing is performed in the high speed, the recording medium is discharged toward the sheet discharged tray in the high speed, and therefore the recording medium may go over the sheet discharged tray and drop off from the sheet discharged tray. As a countermeasure, there is also known an ink-jet recording apparatus having a stopper extending upward at a downstream end of the sheet discharged tray in a discharging direction of the recording medium so that the discharged recording medium is made to collide with the stopper.

SUMMARY OF THE INVENTION

In the conventional apparatus, the image-recorded recording medium is discharged by a recording medium discharging mechanism to the stopper in the high speed, and then collides with the stopper so as to drop onto a sheet placed face of the sheet discharged tray. Thus, since the image-recorded recording medium is dropped to be placed on the sheet placed face, the recording medium having been discharged by the recording medium discharging mechanism hardly rubs against a top one of the recording media already placed on the sheet placed face. Therefore, an image-recorded surface of the recording medium on which the image was recorded is protected from being tainted due to the rub.

However, where a large number of the recording media have already been placed on the sheet placed face so as to form a bundle of the recording media, the recording medium discharged by the recording medium discharging mechanism may rub against a top medium of the bundle before colliding with the stopper, whereby the image-recorded surface of the recording medium may be tainted.

It is an object of the present invention to provide a liquid ejection apparatus configured to prevent the image-recorded surface of the discharged recording medium from being tainted in a case in which a large number of the recording media have already been placed on a sheet placed face, while the liquid ejection apparatus is configured to discharge the image-recorded recording medium toward a stopper in a high speed.

The object indicated above may be achieved according to the present invention which provides a liquid ejection apparatus including: a liquid ejection head configured to eject a liquid onto a recording medium so as to record an image on the recording medium; a drying device configured to dry the recording medium on which the image has been recorded by the liquid ejection head; a sheet discharged tray including a sheet placed face on which a plurality of recording media on which the image has been recorded by the liquid ejection head are placed and stacked; a sheet discharging device configured to discharge the recording medium on which the image has been recorded by the liquid ejection head to a space over the sheet placed face of the sheet discharged tray in a sheets-stacked direction in which the plurality of recording media are stacked; a stopper configured to cause the recording medium discharged by the sheet discharging device to the space over the sheet placed face in the sheets-stacking direction to collide with the stopper and to drop toward the sheet placed face; an obtaining device configured to obtain a height of the plurality of recording media stacked on the sheet placed face of the sheet discharged tray; and a controller configured to control the drying device so that a degree of drying of the recording medium on which the image has been recorded becomes larger in a case in which the height obtained by the obtaining device is equal to or more than a set specific value, than in a case in which the height is less than the set specific value.

The object indicated above may also be achieved according to the present invention which provides a liquid ejection apparatus including: a liquid ejection head configured to eject a liquid onto a recording medium so as to record an image on the recording medium; a sheet discharged tray including a sheet placed face on which a plurality of recording media on which the image has been recorded by the liquid ejection head are stacked and placed; a sheet discharging device configured to discharge the recording medium on which the image has been recorded by the liquid ejection head to a space over the sheet placed face of the sheet discharged tray in a sheets-stacked direction in which the plurality of recording media are stacked; a stopper configured to cause the recording medium discharged by the sheet discharging device to the space over the sheet placed face in the sheets-stacking direction to collide with the stopper and to drop toward the sheet placed face; an obtaining device configured to obtain a height of the plurality of recording media stacked on the sheet placed face of the sheet discharged tray; and a controller configured to control the sheet discharging device so that a speed of discharging the recording medium on which the image has been recorded to the space over the sheet placed face of the sheet discharged tray is larger in a case in which the height obtained by the obtaining device becomes equal to or more than a set specific value, than in a case in which the height is less than the set specific value.

The object indicated above may also be achieved according to the present invention which provides a drying method of a liquid ejection apparatus including a liquid ejection head configured to eject a liquid onto a recording medium so as to record an image on the recording medium, a drying device configured to dry the recording medium on which the image has been recorded by the liquid ejection head, a sheet discharged tray having a sheet placed face on which a plurality of recording media on which the image has been recorded by the liquid ejection head are stacked and placed, a sheet discharging device configured to discharge the recording medium on which the image has been recorded by the liquid ejection head to a space over the sheet placed face of the sheet discharged tray in a sheets-stacked direction in which the plurality of recording media are stacked, and a stopper configured to cause the recording medium discharged by the sheet discharging device to the space over the sheet placed face in the sheets-stacking direction to collide with the stopper and to drop toward the sheet placed face, the drying method including the steps of: obtaining a height of the plurality of recording media stacked on the sheet placed face of the sheet discharged tray; and controlling the drying device so that a degree of drying of the recording medium on which the image has been recorded becomes larger in a case in which the obtained height is equal to or more than a set specific value, than in a case in which the obtained height is less than the set specific value.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which:

FIG. 9 is a table stored in a drying treatment amount setting device;

FIG. 14 is a table stored in a discharge speed setting device;

DETAILED DESCRIPTION OF THE PREFERRED EMBODIMENTS

Figure 1:
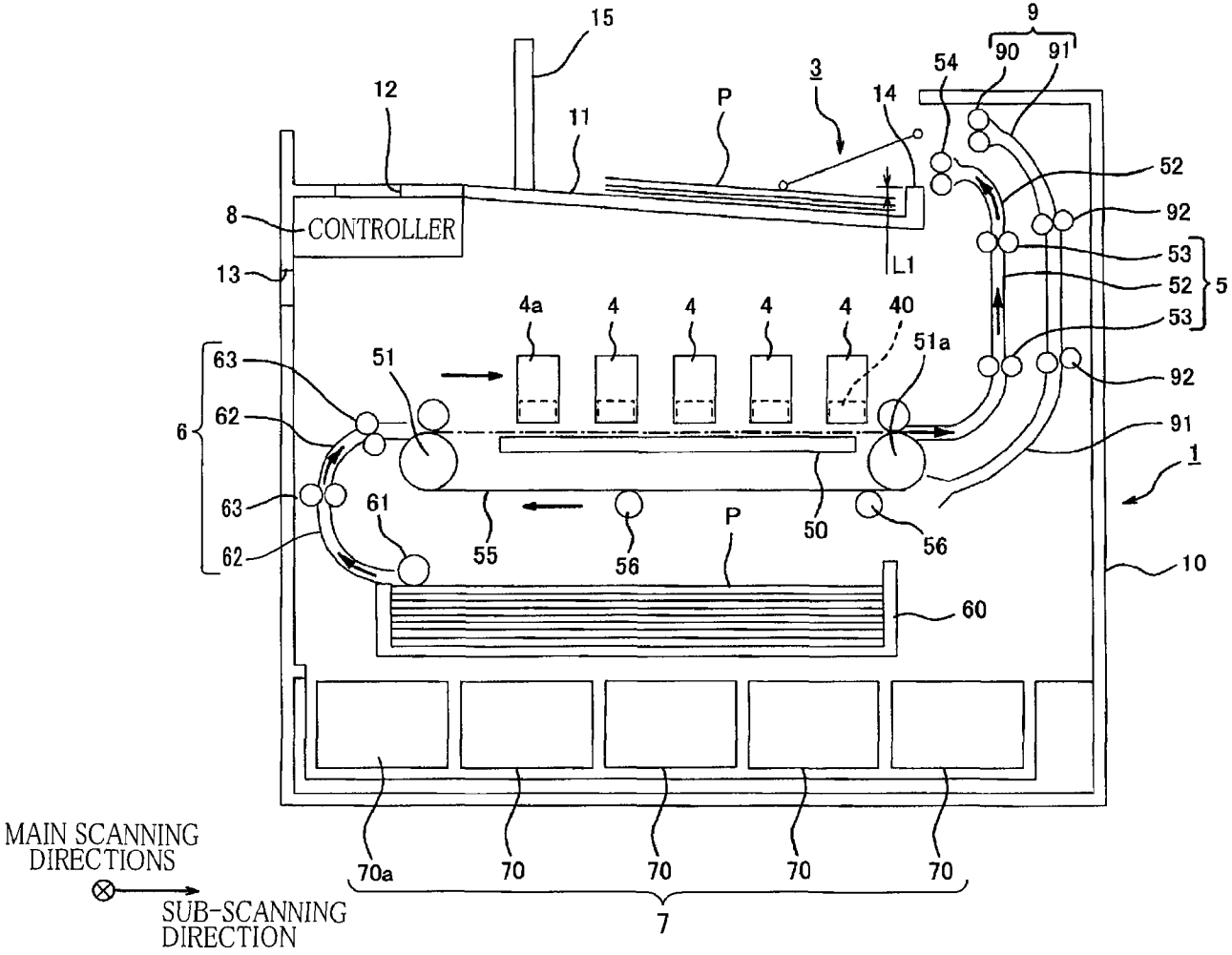
FIG. 1 is a schematic view of a general structure of an ink-jet recording apparatus.

An embodiment according to the present invention is described below in detail with reference to the figures. In this embodiment, a paper sheet P is illustrated as an example of a recording medium. In addition, an ink-jet recording apparatus which ejects an ink onto the paper sheet P is illustrated as a liquid ejection apparatus. Incidentally, water is used as a solvent of the ink.

General Structure of Ink-Jet Recording Apparatus

The ink-jet recording apparatus 1 has a housing 10 having an approximately rectangular parallelepiped shape. A sheet discharged tray 11 is provided in an upper portion of the housing 10. The sheet discharged tray 11 is positioned below a sheet exit 14 provided on the housing 10 and has a bottom plate 11*b* extending obliquely upward relative to a sheet discharging direction in which the paper sheet P is discharged. The paper sheet P on which a printing has been performed, namely, the printed paper sheet P is discharged to the sheet discharged tray 11 in a high speed. A stopper 15 is provided in such a manner as to extend upward like a wall placed at a downstream edge portion of the sheet discharged tray 11 in the sheet discharging direction.

The paper sheet P collides with the stopper 15. In particular, the paper sheet P is firstly discharged to a space over the sheet discharged tray 11. So, the paper sheet P flies toward the stopper 15 and collides with the stopper 15. Then, the paper sheet P drops onto an upper face 11*c* of the bottom plate 11*b* of the sheet discharged tray 11 and is placed on the upper face 11*c*. That is, the upper face 11*c* of the sheet discharged tray 11 constitutes an example of a sheet placed face.

In the housing 10, there are disposed a conveying unit 5, liquid ejection heads 4, a sheet supply unit 6, and a tank group 7 in this order from an upside of the housing 10 toward a downside of the housing 10. A reverse conveying unit 9 is provided at a position closer to an outer wall of the housing 10 than the conveying unit 5. The reverse conveying unit 9 is later described in detail. The liquid ejection heads 4 eject droplets of inks of respective colors, that is, black, cyan, magenta, and yellow, onto the paper sheet P.

The conveying unit 5 is a mechanism which conveys the paper sheet P from a left side to a right side on a drawing sheet of FIG. 1. In the following description, a direction in which the paper sheet P is conveyed in a printing section is referred to as a sub-scanning direction, and a direction perpendicular to the sub-scanning direction is referred to as a main scanning direction. It is noted that a direction in which the paper sheet P is conveyed in a printing is referred to as a sheet conveying direction. The conveying unit 5 conveys the paper sheet P horizontally and then discharges toward the sheet discharged tray 11.

The sheet supply unit 6 supplies the paper sheet P to the conveying unit 5. The tank group 7 includes a plurality of tanks 70 aligned horizontally and storing respective inks of respective colors. A treatment liquid head 4*a* is provided in a downstream region of the sheet supply unit 6 and in an upstream region of the liquid ejection heads 4 in the sheet conveying direction. The treatment liquid head 4*a* is configured to eject a treatment liquid onto the paper sheet P prior to the ejections of the inks. The treatment liquid is a liquid which, before the ink is ejected onto the sheet P, is ejected onto the paper sheet P so as to precipitate or coagulate a component of the ink, thereby maintaining a high printing quality and improving an image quality. Hereinafter, a treatment in which the treatment liquid is ejected onto the paper sheet P prior to the ejection of the ink is referred to as a pre-coat treatment. Accordingly, the tank group 7 also includes a treatment liquid tank 70*a* storing the treatment liquid.

A controller 8 is disposed in an inside upper portion of the housing 10 and at a position in which the controller 8 does not obstruct the liquid ejection head 4. The controller 8 controls operations of mechanisms and electric circuits in the housing 10. A terminal 13 is disposed on a side surface of the housing 10 and below the controller 8. The terminal 13 receives information, in particular, a print job from an information storing apparatus, such as a personal computer, provided outside the housing 10. The print job from the information storing apparatus is inputted to the controller 8 via the terminal 13.

An operation panel 12 is disposed on an upper surface of the housing 10 and is electrically connected to the controller 8. A user can operate the operation panel 12 so as to determine performing a one-side printing or a two-side printing on the paper sheet P. The user can also operate the operation panel 12 so as to determine performing the pre-coat treatment on the paper sheet P or not. Incidentally, the print job may include an instruction of performing the one-side printing or the two-side printing on the paper sheet P, and an instruction of performing the pre-coat treatment on the paper sheet P or not.

The conveying unit 5 includes: a platen 50 extending in the sub-scanning direction; belt rollers 51, 51*a* each disposed at a corresponding one of opposite sides of the platen 50 in the sub-scanning direction; an endless belt 55 wound around the belt rollers 51, 51*a*; a plurality of support rollers 56 disposed below the endless belt 55 and configured to nip the paper sheet P conveyed from the reverse conveying unit 9. The conveying unit 5 further includes a guide 52, first conveyance roller pairs 53, and a second conveyance roller pair 54 all of which are disposed between the belt roller 51*a* and the sheet discharged tray 11. The belt roller 51*a* is arranged in a downstream region of the platen 50 in the sheet conveying direction. The belt roller 51 arranged in an upstream region of the platen 50 in the sheet conveying direction applies a conveying force to the paper sheet P, and thus the paper sheet P is conveyed while supported on the platen 50. The paper sheet P having passed across the platen 50 receives an application of another conveying force by the belt roller 51*a* arranged in a downstream region of the platen 50 in the sheet conveying direction, and the paper sheet P is then conveyed toward the sheet discharged tray 11 by the guide 52, the first conveyance roller pairs 53, and the second conveyance roller pair 54. The first conveyance roller pairs 53 and the second conveyance roller pair 54 are rotatively driven by a motor M (refer to FIG. 2) connected to the controller 8. The first conveyance roller pairs 53, the second conveyance roller pair 54, and the motor M constitute an example of a sheet discharging device.

The sheet supply unit 6 includes a sheet supply tray 60, a sheet supply roller 61, two guides 62, and two conveyance roller pairs 63. The two guides 62 and the two conveyance roller pairs 63 are disposed between the sheet supply roller 61 and the conveying unit 5. The sheet supply roller 61 picks a top one of the paper sheets P on the sheet supply tray 60 and conveys the top one toward the upstream region of the conveying unit 5 in the sheet conveying direction, by the guides 62 and the conveyance roller pairs 63.

The liquid ejection head 4 is a line head having a rectangular parallelepiped shape extending in the main scanning direction. A bottom face of the liquid ejection head 4 is formed as a nozzle face 40 on which a plurality of liquid ejection holes for ejecting the inks are formed. Each of the liquid ejection heads 4 is connected via a tube (not shown in the figures) to a corresponding one of the tanks 70 each having the ink of the color to be ejected. The ink in a form of droplet is ejected through each of the liquid ejection holes of the nozzle face 40. Each ejected liquid droplet has one of three sizes, that is, a large size, a middle size, and a small size, according to a diameter of the liquid ejection hole.

Drying Mechanism

A part of the conveying unit 5 and a heater 20 described later constitute a drying mechanism 2 which dries the inks on the paper sheet P. If the inks on the paper sheet P which flies toward the stopper 15 were not fully dried, the inks on the paper sheet P having flown toward the stopper 15 might attach to the top paper sheet P of the bundle of paper sheets P stacked on the sheet discharged tray 11 when the paper sheet P having flown toward the stopper 15 rubs against the top paper sheet P. The drying mechanism 2 is configured to fully dry the inks ejected on the paper sheet P on which the printing has been performed and then discharge the paper sheet P toward the sheet discharged tray 11.

Figure 2:
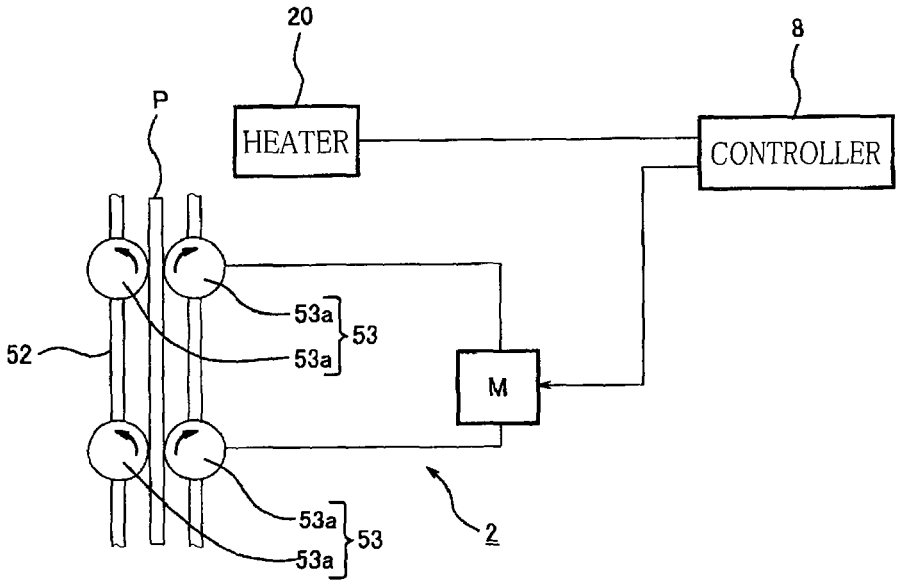
FIG. 2 is a schematic view of a detailed structure of a drying mechanism.

Referring to FIG. 2, the first conveyance roller pair 53 is constituted by two conveyance rollers 53*a* pushed in respective directions in which the conveyance rollers 53*a* come close to each other. A part of each of the conveyance rollers 53*a* is positioned in a conveying path of the paper sheet P through an opening (not shown in the figures) formed on the guide 52. The two conveyance rollers 53*a* nip and convey the paper sheet P. One conveyance roller 53*a* of the first conveyance roller pair 53 is connected to the motor M and is rotated by the motor M. The motor M also rotates the second conveyance roller pair 54.

When the rotation of the motor M is stopped in the middle of the conveyance of the paper sheet P while the paper sheet P is nipped between the two conveyance rollers 53*a*, the paper sheet P is halted in the conveying path, that is, in a waiting state in which the paper sheet P is stopped and kept straight and vertical while a shape of the paper sheet P is kept. This waiting state is continued for a set time so as to dry the inks on the paper sheet P. The set time for which the waiting state is continued is referred to as a waiting time. In addition, stopping the printed paper sheet P for the waiting time to dry the inks on the paper sheet P can correct a curl of the paper sheet P.

Instead of stopping the printed paper sheet P for the waiting time, the motor M may be rotated in a low speed so as to convey the paper sheet P in a low speed, whereby the inks on the paper sheet P may be dried.

In addition, the heater 20 is disposed adjacent to the conveyance rollers 53*a*. When the heater 20 blows a hot air, the paper sheet P conveyed by the conveyance rollers 53*a* is exposed to the hot air so as to be heated. When the heater 20 blows the hot air while the paper sheet P is kept in the waiting state or is conveyed in the low speed, drying the paper sheet P is expedited.

The motor M and the heater 20 constituting the drying mechanism 2 are both connected to the controller 8 independently each other. The controller 8 controls the waiting time for the motor M, and controls a heating time and a heating temperature for the heater 20.

The waiting time, the heating time, and the heating temperature which are set for the drying mechanism 2 in order to dry the paper sheet P, are collectively referred to as a drying treatment amount. When the heater 20 heats the paper sheet P for the heating time, the motor M stops the conveyance of the paper sheet P or conveys the paper sheet P in the low speed for at least the heating time.

Hereinafter, a degree of drying indicates a degree of a change from a not-dried state of the ink to a dried state of the ink. The not-dried state of the ink is a state in which the ink (and the like) ejected from the liquid ejection head 4 onto the paper sheet P is not absolutely dried after the landing of the ejected ink onto the paper sheet P. That is, the degree of drying in the not-dried state of the ink indicates a degree of the ink at a time when the ejected ink has landed. On the other hand, the dried state of the ink is a state in which the ink ejected from the liquid ejection head 4 onto the paper sheet P has been dried. Alternatively, a degree of drying may be defined by another way. In particular, firstly, two test pieces are come into contact with respective surfaces of the two paper sheet P onto one of which the liquid had been ejected and has been dried and onto the other of which the liquid had been ejected and has not absolutely been dried. Then, an amount of the liquid attached (transferred) from the paper sheet P to the test piece is measured for each of the test pieces. Finally, a difference of the two amounts may be defined as the degree of drying. In other words, a degree of drying is a value indicating how much water has evaporated from the liquid ejected onto the paper sheet P.

Reverse Conveying Unit

As described above, the ink-jet recording apparatus 1 can perform the two-side printing (a duplex printing) on the paper sheet P. In order to perform the two-side printing, the reverse conveying unit 9 conveys the paper sheet P to the conveying unit 5 again just before the paper sheet P onto which the inks has been ejected by the liquid ejection head 4 reaches to the sheet receiving tray 11.

As shown in FIG. 1, the reverse conveying unit 9 includes a reverse conveyance roller pair 90, a reverse conveying guide 91, and reverse-turn conveyance roller pairs 92. The reverse conveyance roller pair 90 is disposed above the second conveyance roller pair 54 and in an opposite side of the sheet discharged tray 11 with respect to the second conveyance roller pair 54. The reverse conveying guide 91 extends downward from the reverse conveyance roller pair 90 The reverse-turn conveyance roller pairs 92 are configured to convey the paper sheet P downward along the reverse conveying guide 91. A lower end of the reverse conveying guide 91 is directed to one of the support rollers 56 disposed under the belt roller 51*a*.

Figure 3A:
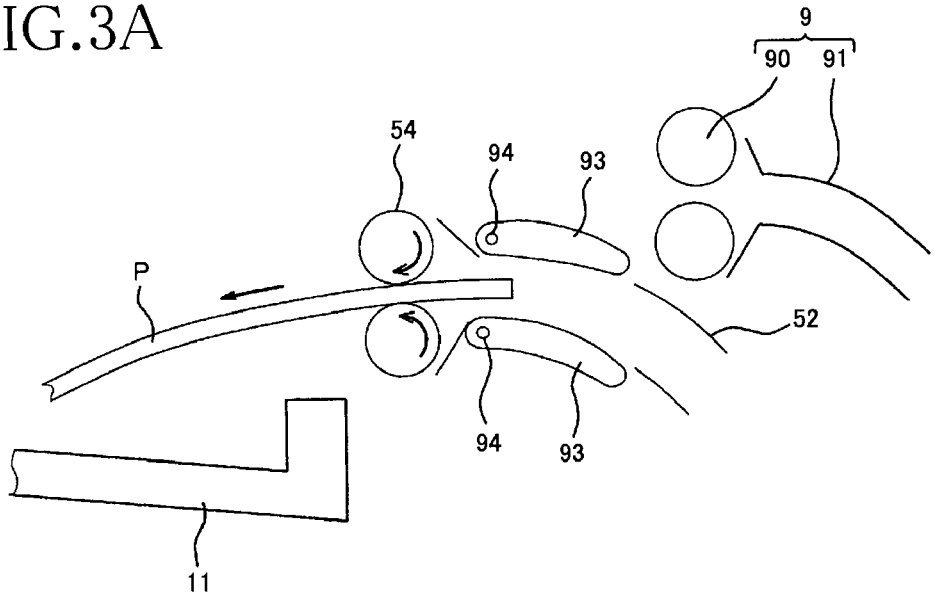
FIGS. 3A and 3B are enlarged views of an upper portion of a reverse conveying unit.
Figure 3B:
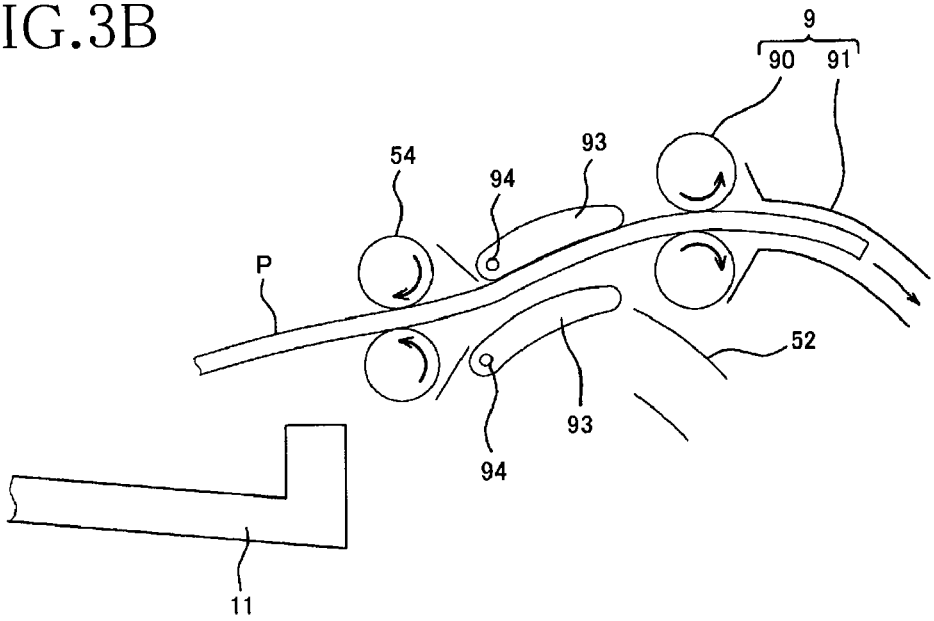

As shown in FIGS. 3A and 3B, conveyance switch guides 93 each extending along the conveying path of the paper sheet P are disposed between the second conveyance roller pair 54 and the guide 52. Each of the conveyance switch guides 93 is pivotable around a corresponding center shaft 94. The conveyance switch guides 93 pivot between respective first positions, as shown in FIG. 3A, in which the conveyance switch guides 93 are directed to the guide 52 and respective second positions, as shown in FIG. 3B, in which distal ends of the conveyance switch guides 93 are moved above the guide 52. When the conveyance switch guides 93 are in the respective second positions, the distal ends of the conveyance switch guides 93 are directed to the reverse conveyance roller pair 90. The conveyance switch guides 93 are rotatively driven by a motor (not shown in the figures) connected to the controller 8.

In a case of performing the two-side printing on the paper sheet P, the conveyance switch guides 93 are pivoted to the respective first position, as shown in FIG. 3A. Then, the paper sheet P on which a printing was performed on one side thereof is conveyed by the second conveyance roller pair 54 toward the sheet discharged tray 11. When a tailing edge of the paper sheet P passes between the conveyance switch guides 93, the conveyance switch guides 93 are pivoted around the respective center shafts 94 to the respective second positions, as shown in FIG. 3B. At the same time, the second conveyance roller pair 54 is reversely rotated, and thus the paper sheet P is pulled back from the sheet discharged tray 11. The paper sheet P is conveyed through the conveyance switch guides 93 to the reverse conveyance roller pair 90. The reverse conveyance roller pair 90 conveys the paper sheet P downward along the reverse conveying guide 91. When the paper sheet P reaches to the lower end of the reverse conveying guide 91 by the reverse-turn conveyance roller pairs 92, the paper sheet P is nipped by the support rollers 56 and the endless belt 55, and then conveyed in a direction opposite to the sheet conveying direction. The paper sheet P is turned upside down by the belt roller 51, that is, the paper sheet P is turned so that a front side having been printed faces downward, and then the paper sheet P is disposed below the liquid ejection head 4 in a state in which the surface having been printed faces downward. Thus, the inks are ejected onto a surface of a not-printed side of the paper sheet P (a back side of the paper sheet P) so that two-side printing is performed.

Detail Around Sheet Discharged Tray

Figure 4:
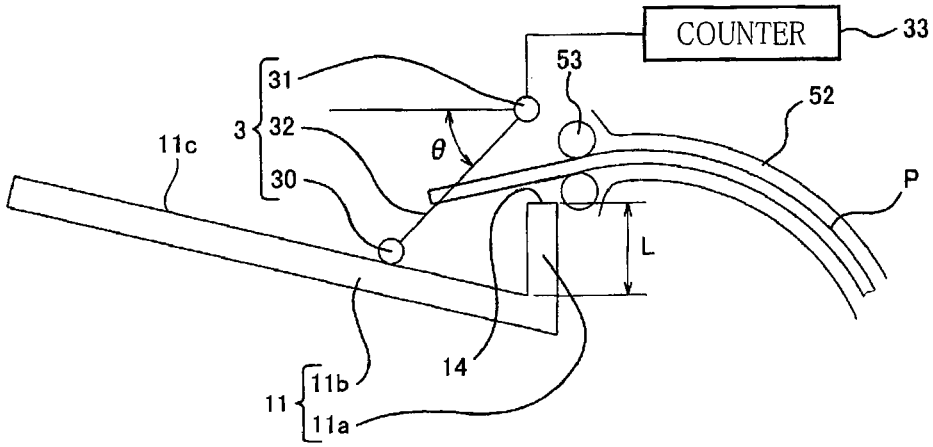
FIG. 4 is a schematic view of a structure in a neighborhood of a receiving tray.

As shown in FIG. 4, the sheet discharged tray 11 includes the bottom plate 11*b* and a vertical wall 11*a* extending upward from a lower edge of the bottom plate 11*b*. An upper edge of the vertical wall 11*a* is positioned at a lower end of the sheet exit 14. A pendulum mechanism 3 is provided inside the housing 10 and above the bottom plate 11*b*.

The pendulum mechanism 3 includes a pivot center shaft 31, a contact piece 30, and a connection rod 32. The pivot center shaft 31 is supported to the housing 10 at a position above the vertical wall 11*a*. The contact piece 30 is contactable with a top of the paper sheet P discharged to the bottom plate 11*b* from the sheet exit 14. The connection rod 32 connects with the pivot center shaft 31 and the contact piece 30. The contact piece 30 and the connection rod 32 are pivotable around the pivot center shaft 31. The connection rod 32 is positioned in a downstream region of the sheet exit 14 in the sheet discharging direction in order not to obstruct a drop of the paper sheet P discharged from the sheet exit 14 to the bottom plate 11*b*. The paper sheet P discharged from the sheet exit 14 slides obliquely upward along the bottom plate 11*b* on the bottom plate 11*b* or the already discharged paper sheet P, thereby coming into contact with the contact piece 30 and raising the contact piece 30 by a thickness of the paper sheet P. The pivot center shaft 31 is provided with an angle sensor (not shown in the figures). The angle sensor is connected to a counter 33. An angle between the connection rod 32 and a horizontal face is indicated as θ. As the paper sheets P are stacked on the bottom plate 11*b*, the contact piece 30 is raised and the pivot center shaft 31 is pivoted. Therefore, since a value of the angle θ is changed, the counter 33 can obtain, based on a change amount of the angle, a stack height along a sheets-stacking direction of the paper sheets P. The sheets-stacking direction is a vertical direction, or a direction of a height of the plurality of paper sheets P stacked on the discharged tray 11, that is, a direction perpendicular to the upper face 11*c*. Accordingly, the pendulum mechanism 3 and the counter 33 constitute an example of an obtaining device. Incidentally, since the contact piece 30 is made of a light material, the contact piece 30 is configured to be collided by and flipped up by the paper sheet P when the paper sheet P is discharged from the sheet exit 14. In addition, when the contact piece 30 is flipped up by the paper sheet P, the angle θ is abruptly changed. However, this abrupt change is excluded from the above obtaining of the stack height.

Figure 5:
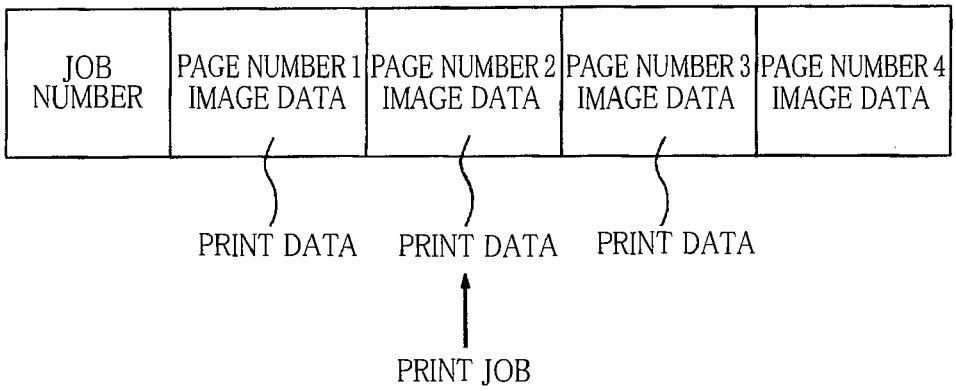
FIG. 5 is a diagram of a format of a print job.

As shown in FIG. 5, the print job contains a job number and print data subordinate to the job number. The print data contains a page number, and image data regarding an image corresponding to the page number. When the print job contains a plurality of print data, the plurality of print data are arrayed in an order of printing, like an array from a left to a right shown in a schematic diagram of FIG. 5.

In addition, the image data contains, for example, a flag indicating whether a printing is one-side printing or two-side printing, a flag indicating whether or not the pre-coat treatment is performed, vector image data used as a reference for calculating a size and a volume of the ink droplet ejected on each of dot areas on the paper sheet P, and so on.

Configuration of Controller

Figures 6, 7:
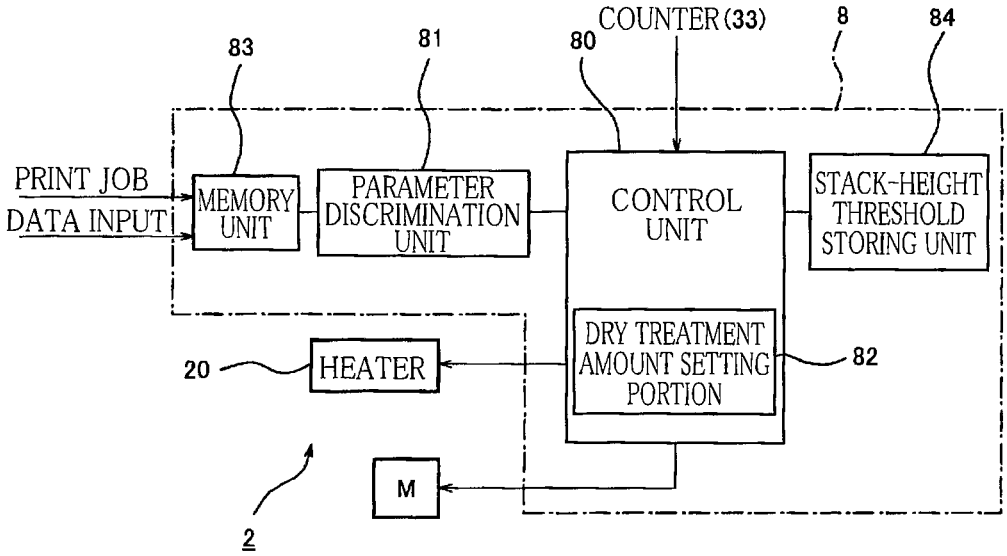
FIG. 6 is a block diagram of a configuration of a controller.
FIG. 7 is a table stored in a drying treatment amount setting device.

As shown in FIG. 6, the controller 8 includes, as hardwares, a CPU (Central Processing Unit), a ROM (Read Only Memory) configured to store, as softwares, programs to be executed by the CPU and data to be used by the programs, a RAM (Random Access Memory) configured to temporarily stores data in an execution of the program, and a nontransitory memory. Each of functional units constituting the controller 8 is constructed by an cooperation of the hardwares and the softwares in the ROM.

The controller 8 includes, as the functional unit, a memory unit 83 configured to temporarily store the print job and data inputted from a user via the operation panel 12, a parameter discrimination unit 81 connected to the memory unit 83, a control unit 80 connected to the parameter discrimination unit 81 and the counter 33, and a stack-height threshold storing unit 84 storing a threshold regarding the stack height of the paper sheets P discharged on the sheet discharged tray 11. The control unit 80 includes a drying-treatment-amount setting portion 82 configured to set the heating time and so on for the drying mechanism 2.

The parameter discrimination unit 81 reads a parameter contained in the print job and the data inputted from a user, and discriminates a content of the parameter. In addition, the parameter discrimination unit 81 may successively receive a plurality of said print jobs. The control unit 80 controls the ejection of the liquid ejection head 4, and orders the drying-treatment-amount setting portion 82 to set the drying treatment amount on the basis on the content of the parameter discriminated by the parameter discrimination unit 81.

First Embodiment

When a value of the stack height of the printed paper sheets P stacked on the sheet discharged tray 11 is small, a vertical length L1 between the top one of the paper sheets P and the sheet exit 14 is long, as shown in FIG. 1. Accordingly, the paper sheet P flying from the sheet exit 14 toward the stopper 15 is unlikely to rub against the top paper sheet P on the sheet discharged tray 11. Therefore, even if the inks on the paper sheet P flying from the sheet exit 14 toward the stopper 15 is not fully dried, the inks on the flying paper sheet P will not attach to the top paper sheet P.

In contrast, when a large number of said paper sheets P are stacked on the sheet discharged tray 11 and the value of the stack height of the paper sheets P is large, the vertical length L1 between the top one of the paper sheets P and the sheet exit 14 is short. Accordingly, the paper sheet P flying from the sheet exit 14 toward the stopper 15 is likely to rub against the top paper sheet P. Therefore, if the inks on the paper sheet P flying from the sheet exit 14 toward the stopper 15 is not fully dried, the inks on the flying paper sheet P will attach to the top paper sheet P. So, when the stack height of the paper sheets P on the sheet discharged tray 11 is equal to or more than a set specific height, the drying treatment amount applied to the paper sheet P is increased to fully dry the inks on the paper sheet P.

In the first embodiment, the heating time of the heater 20 is cited as one example of the drying treatment amount. In other words, the drying-treatment-amount setting portion 82 may be referred to as a hearting amount setting portion. For example, the threshold of the stack height of the paper sheets P stored in the stack-height threshold storing unit 84 is set to 5 cm herein. The drying-treatment-amount setting portion 82 stores a table T0 regarding a relation between the value of the stack height of the paper sheets P on the sheet discharged tray 11 and the value of the heating time according to the stack height. According to the table T0 shown in FIG. 7, when the stack height is equal to or more than 5 cm which is the threshold stored in the stack-height threshold storing unit 84, the value of the heating time is set to be longer as the stack height becomes higher. It is noted that, the table T0 is constituted in the same print condition, that is, in a case of printing the same images on the paper sheets P and therefore ejecting the same amounts of the inks and the treatment liquid.

According to the table T0, when the stack height is less than 5 cm which is the threshold stored in the stack-height threshold storing unit 84, the value of the heating time is set to a constant time T, specifically, 0.5 second (hereinafter abbreviated as "sec."). The constant time T is shorter than the heating time in the case in which the stack height of the stack height of the paper sheets P is equal to 5 cm being the threshold. The values of the heating time and the stack height according to FIG. 7 are determined for this embodiment and are not limited. Additionally, when the value of the stack height N of the paper sheets P is less than 5 cm which is the threshold stored in the stack-height threshold storing unit 84, the constant time T being the value of the heating time may be 0 sec. That is, when the value of the stack height N of the paper sheets P is less than 5 cm which is the threshold stored in the stack-height threshold storing unit 84, the drying by the heating may not be performed. In this case, the paper sheet P may not be halted at a predetermined position.

Operation of Controller

Figure 8:
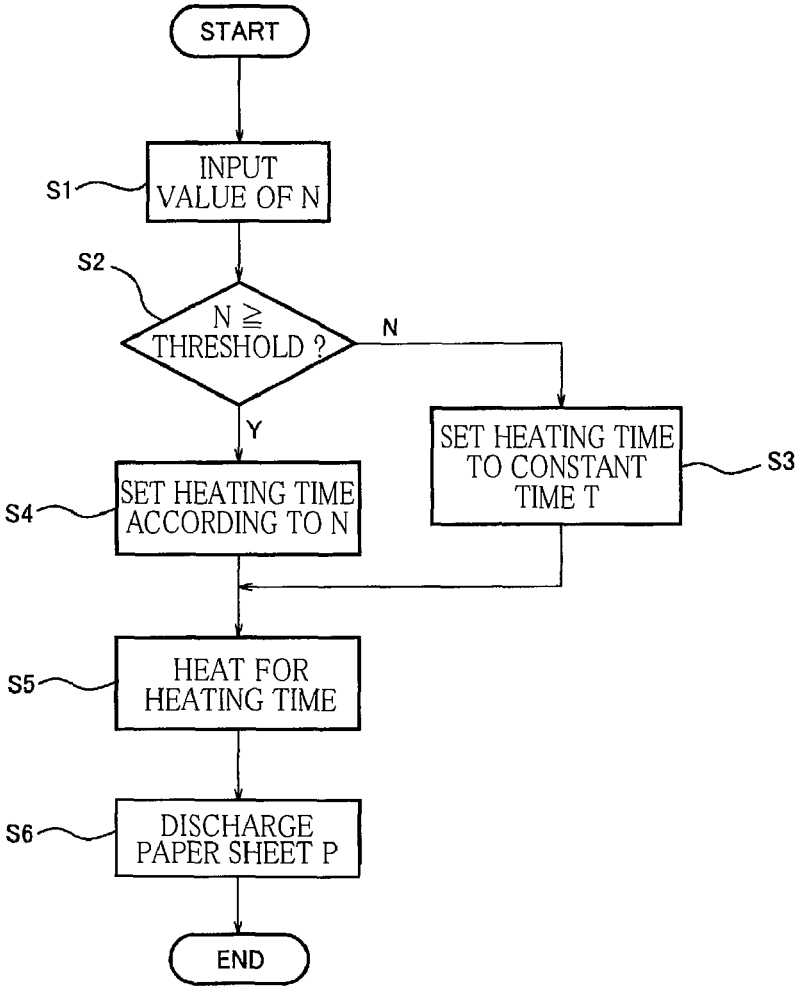
FIG. 8 is a flow chart representing an operation of the controller of a first embodiment.

A detailed operation of the controller 8 is described with reference to FIG. 8 as below. When the print job is inputted into the parameter discrimination unit 81 via the memory unit 83, the control unit 80 starts a measurement of the stack height N of the paper sheets P stacked on the sheet discharged tray 11. When a value of the stack height N of the paper sheets P stacked on the sheet discharged tray 11 is inputted from the counter 33 (step S1), the control unit 80 reads the threshold from the stack-height threshold storing unit 84. Next, the control unit 80 determines whether the value of the stack height N of the paper sheets P is equal to or more than the threshold (step S2). When the value of the stack height N of the paper sheets P is less than the threshold, the control unit 80 transmits, to the drying-treatment-amount setting portion 82, information that the value of the stack height N of the paper sheets P is less than the threshold, and the drying-treatment-amount setting portion 82 sets the heating time of the heater 20 to the constant time T (step S3). The drying-treatment-amount setting portion 82 orders the drying mechanism 2, specifically, the heater 20 to heat for the constant time T which is the set heating time (step S5). When the control unit 80 detects a completion of the ejection of the inks from the liquid ejection head 4 onto the paper sheet P for the print data, the paper sheet P onto which the inks and so on have been ejected is halted at the predetermined position in the guide 52, and then the drying-treatment-amount setting portion 82 orders the heater 20 to heat for the constant time T.

When the value of the stack height N of the paper sheets P is equal to or more than the threshold in the step S2, the control unit 80 transmits, to the drying-treatment-amount setting portion 82, information that the value of the stack height N of the paper sheets P is equal to or more than the threshold, and the drying-treatment-amount setting portion 82 sets the heating time of the heater 20 to a time according to the value of the stack height N of the paper sheets P (step S4). The drying-treatment-amount setting portion 82 reads out the time according to the value of the stack height N of the paper sheets P, from the table T0 stored in the drying-treatment-amount setting portion 82, and then orders the heater 20 to heat for the heating time (step S5). In this step, the heating time is set to become stepwisely longer as the value of the stack height N of the paper sheets P becomes larger.

After the set heating time has passed, the drying-treatment-amount setting portion 82 orders the motor M to rotate, and the printed paper sheet P in which the inks has been dried is thrown toward the stopper 15 so as to be discharged on the sheet discharged tray 11 (step S6).

In the ink-jet recording apparatus 1 of the first embodiment, when the value of the stack height N of the paper sheets P stacked on the sheet discharged tray 11 is equal to or more than the threshold, the heating time for heating the paper sheet P is set to be longer so as to fully dry the inks on the paper sheet P. Therefore, even if the paper sheet P flying toward the stopper 15 rubs against the top one of the paper sheets P stacked on the sheet discharged tray 11, the inks of the flying paper sheet P are less likely to attach to the top paper sheet P.

In the above description, the heating time of the heater 20 is illustrated as the drying treatment amount to be set by the drying-treatment-amount setting portion 82. Alternatively, the heating temperature of the heater 20 may be cited as the drying treatment amount. That is, the heating temperature of the heater 20 may be set to be the constant temperature when the value of the stack height N of the paper sheets P is less than the threshold, and the heating temperature of the heater 20 may be set to become stepwisely higher as the value of the stack height N of the paper sheets P increases, when the value of the stack height N of the paper sheets P is equal to or more than the threshold. In the case that the heating temperature of the heater 20 is used as the drying treatment amount to be set by the drying-treatment-amount setting portion 82, when the value of the stack height N of the paper sheets P is less than the threshold, the heating temperature may not be set. In other words, when the value of the stack height N of the paper sheets P is less than the threshold, the heating may not be performed. In this case, the paper sheet P may not be halted at the predetermined position.

Modification of First Embodiment

In the ink-jet recording apparatus 1 of the first embodiment, the heating time is varied on the basis of whether the value of the stack height N of the paper sheets P on the sheet discharged tray 11 is equal to or more than the threshold. Alternatively, the heating time may be varied on the basis of the length L1 between the top one of the paper sheets P stacked on the sheet discharged tray 11 and the sheet exit 14 (refer to FIG. 1). The length L1 is calculated by deducting the value of the stack height N from a length L from a top edge of the vertical wall 11*a* to the bottom plate 11*b* of the vertical wall 11*a*. A value of the length L is stored, for example, in the control unit 80.

When the length L1 is long, the number of the paper sheets P stacked on the sheet discharged tray 11 is small, and therefore the paper sheet P flying from the sheet exit 14 toward the stopper 15 is unlikely to rub against the top paper sheet P on the sheet discharged tray 11. Therefore, the inks on the paper sheet P flying from the sheet exit 14 toward the stopper 15 does not need to be fully dried, so the heating time may be short.

In contrast, when the length L1 is short, the number of the paper sheets P stacked on the sheet discharged tray 11 is large, and therefore the paper sheet P flying from the sheet exit 14 toward the stopper 15 is likely to rub against the top paper sheet P on the sheet discharged tray 11. Therefore, the inks on the paper sheet P flying from the sheet exit 14 toward the stopper 15 needs to be fully dried, so the heating time needs to be long.

As such, the control unit 80 can perform the same operation as the first embodiment by calculating the length L1 on the basis of the values of the length L and the stack height N.

Second Embodiment

When the print job contains information regarding the two-side printing, or when the operation panel 12 is operated for the two-side printing, the two-side printing is performed. When the two-side printing is performed on a certain paper sheet P, both printed faces of the certain paper sheet P rubs against respective printed faces of other paper sheets P one of which is placed just above the certain paper sheet P and the other of which is placed just under the certain paper sheet P. Therefore, when the certain paper sheet P drops onto the bundle of the paper sheets P, one of printed faces of the certain paper sheet P rubs against a printed face of the top paper sheet P of the bundle, and the other of printed faces of the certain paper sheet P will be rubbed against a printed face of another paper sheet P to be subsequently dropped. That is, when the certain paper sheet P is not fully dried, the inks may attach to the top paper sheet P of the bundle and the another paper sheet P to be subsequently dropped. Therefore, in a case of the two-side printing, the inks on the paper sheet P needs to be fully dried, compared to the one-side printing.

Figure 10:
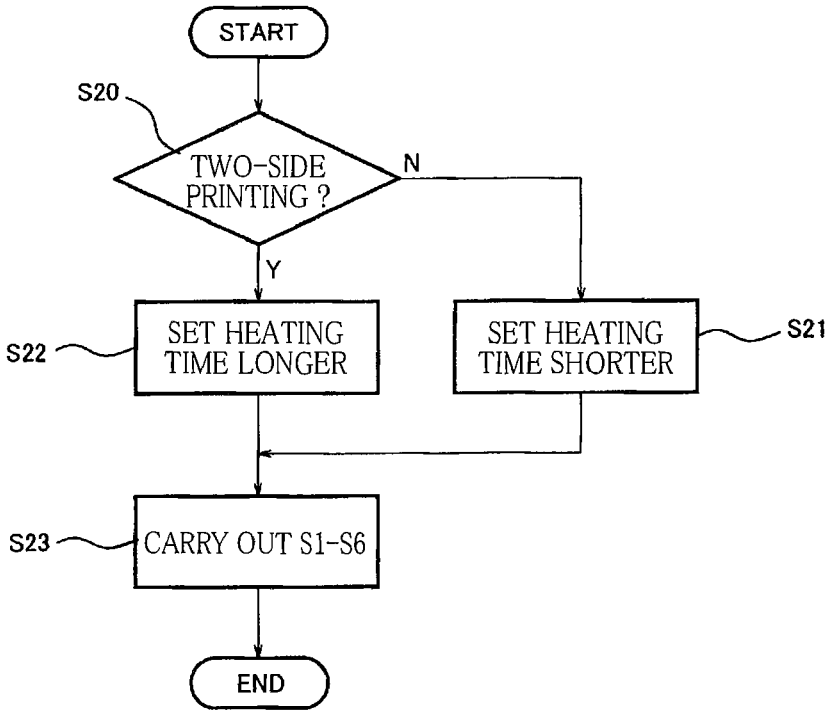
FIG. 10 is a flow chart representing an operation of the controller of a second embodiment.

A table stored in a drying-treatment-amount setting portion 82 includes a first table T1 and a second table T2, as shown in FIG. 9. The first table T1 stores, for the one-side printing, values representing the heating times corresponding to respective values representing the stack height of the paper sheets P. The second table T2 stores, for the two-side printing, values representing the heating times corresponding to respective values representing the stack height of the paper sheets P. The heating time needs to be long in the case of the two-side printing, compared to the case of the one-side printing. Accordingly, when the stack height is the same between the case of the two-side printing and the one-side printing, the value of the heating time according to the second table T2 is larger than the value of the heating time according to the first table T1. The values of the heating time according to the tables of FIG. 9 are determined for this embodiment and are not limited. For example, in the first table T1, when the value of the stack height N of the paper sheets P is less than the threshold, the heating time may be 0 sec. In this case, the paper sheet P may not be halted at the predetermined position. An operation of the controller 8 is described with reference to FIG. 10 as below.

The parameter discrimination unit 81 determines whether the one-side printing or the two-side printing is performed for the paper sheet P, based on the print job or the information inputted by the user to the operation panel 12 (step S20). This determination result is transmitted to the control unit 80. In other words, the parameter discrimination unit 81 may be referred to as a recording condition inputting unit.

When it is determined in the step S20 that the one-side printing is performed, the control unit 80 transmits information that the one-side printing is performed, to the drying-treatment-amount setting portion 82. The drying-treatment-amount setting portion 82 sets, for the drying mechanism 2, the heating time corresponding to the one-side printing. That is, the drying-treatment-amount setting portion 82 reads out the heating time from the first table T1, and then sets, for the heater 20, the heating time shorter than the heating time in the case of the two-side printing (step S21).

When it is determined in the step S20 that the two-side printing is performed, the control unit 80 transmits information that the two-side printing is performed, to the drying-treatment-amount setting portion 82. The drying-treatment-amount setting portion 82 sets, for the drying mechanism 2, the heating time corresponding to the two-side printing. That is, the drying-treatment-amount setting portion 82 reads out the heating time from the second table T2, and then sets, for the heater 20, the heating time longer than the heating time in a case of the one-side printing (step S22).

Afterward, the control unit 80 and the drying-treatment-amount setting portion 82 carry out the process from the step S1 to the step S6 (step S23). That is, the heating time is read out from the first table T1 or the second table T2 according to the stack height of the paper sheets P, and the heater 20 is heated for the read heating time.

As described above, in the case of the two-side printing, the inks on the paper sheet P are fully dried, compared to the one-side printing. Therefore, when the paper sheet P is stacked onto the sheet discharged tray 11, the inks are less likely to attach to the adjacent paper sheets P.

Third Embodiment

The paper sheet P may be a sheet into which the ink is easy to infiltrate, such as a coarse paper. Hereinafter, this type of sheet is referred to be high in an ink infiltration degree. On the other hand, the paper sheet P may be a sheet into which the ink is hard to infiltrate, such as an ink-jet printing paper. Hereinafter, this type of sheet is referred to be low in an ink infiltration degree. Where a certain paper sheet P on which the printing is performed is low in the ink infiltration degree, the inks are likely to attach to the top paper sheet P of the bundle when the certain paper sheet P rubs against the top paper sheet P. Therefore, where the certain paper sheet P on which the printing is performed is low in the ink infiltration degree, it is needed to fully dry the inks on the piece of said paper sheet P, compared to the paper sheet P being high in the ink infiltration degree. Information regarding the type of said paper sheet P can be inputted by the user from the operation panel 12.

The table stored in a drying-treatment-amount setting portion 82 includes a third table T3 and a fourth table T4. The third table T3 stores, for the paper sheet P being high in the ink infiltration degree, values representing the heating times corresponding to respective values representing the stack height of the paper sheets P. The fourth table T4 stores, for the paper sheet P being low in the ink infiltration degree, values representing the heating times corresponding to respective values representing the stack height of the paper sheets P. A configuration of the third table T3 is almost the same as a configuration of the first table T1 shown in FIG. 9, and the a configuration of the fourth table T4 is almost the same as a configuration of the second table T2 shown in FIG. 9.

Figure 11:
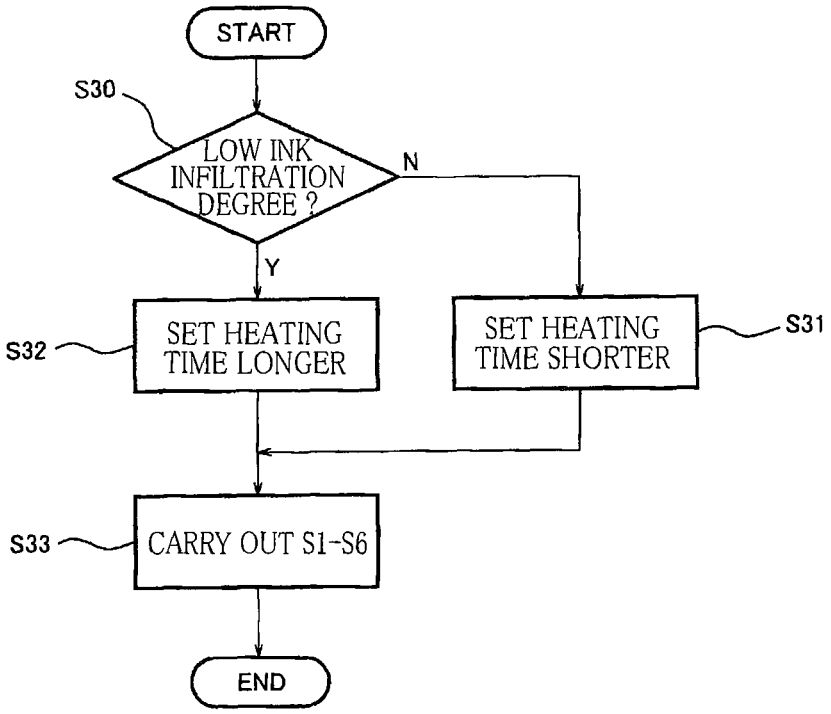
FIG. 11 is a flow chart representing an operation of the controller of a third embodiment.

The heating time needs to be long in the case of the paper sheet P being low in the ink infiltration degree, compared to the case of the paper sheet P being high in the ink filtration degree. Accordingly, when the stack height is the same between the case of the paper sheet P being low in the ink infiltration degree and the case of the paper sheet P being high in the ink filtration degree, the value of the heating time according to the fourth table T4 is larger than the value of the heating time according to the third table T3. Additionally, in the third table T3, when the value of the stack height N of the paper sheets P is less than the threshold, the heating time may be 0 sec. In this case, the paper sheet P may not be halted at the predetermined position. An operation of the controller 8 is described with reference to FIG. 11 as below.

The parameter discrimination unit 81 determines whether the paper sheet P is a sheet being low or high in the ink infiltration degree, based on the information inputted by the user to the operation panel 12 (step S30). This determination result is transmitted to the control unit 80. In other words, the parameter discrimination unit 81 may be referred to as a recording condition input unit.

When it is determined in the step S30 that the paper sheet P is a sheet being high in the ink infiltration degree, the control unit 80 transmits information that the paper sheet P is a sheet being high in the ink infiltration degree, to the drying-treatment-amount setting portion 82. The drying-treatment-amount setting portion 82 sets the heating time corresponding to the paper sheet P being high in the ink infiltration degree, for the drying mechanism 2, specifically, for the heater 20. That is, the drying-treatment-amount setting portion 82 reads out the heating time from the third table T3, and then sets, for the heater 20, the heating time shorter than the heating time in a case of the paper sheet P being low in the ink infiltration degree (step S31).

When it is determined in the step S30 that the paper sheet P is a sheet being low in the ink infiltration degree, the control unit 80 transmits information that the paper sheet P is a sheet being low in the ink infiltration degree, to the drying-treatment-amount setting portion 82. The drying-treatment-amount setting portion 82 sets the heating time corresponding to the paper sheet P being low in the ink infiltration degree, for the heater 20. That is, the drying-treatment-amount setting portion 82 reads out the heating time from the fourth table T4, and then sets, for the heater 20, the heating time longer than the heating time in a case of the paper sheet P being high in the ink infiltration degree (step S32).

Afterward, the control unit 80 and the drying-treatment-amount setting portion 82 carry out the process from the step S1 to the step S6 (step S33). That is, the heating time is read out from the third table T3 or the fourth table T4 according to the stack height of the paper sheets P, and the heater 20 is heated for the read heating time.

Where the paper sheet P is low in the ink infiltration degree, it takes a longer time to fully dry the inks on the paper sheet P, compared to the paper sheet P being high in the ink infiltration degree. Therefore, in the case of the paper sheet P being low in the ink infiltration degree, the heating time is set to be longer to fully dry the inks on the paper sheet P.

As describe above, information regarding the type of the paper sheet P is inputted by the user from the operation panel 12. Alternatively, the ink jet recording apparatus 1 may include sheet supply trays 60 each dedicated for the corresponding type of the paper sheet P, specifically, for each type of the paper sheets P being different in the ink infiltration degree from each other. In this case, an identification label may be provided on an outer surface of each of the sheet supply trays 60, and a reading device configured to read the identification label may be provided in the housing 10.

When the sheet supply tray 60 is loaded in the housing 10, the reading device reads the identification label, and automatically identifies data regarding the ink infiltration degree of the paper sheet P in the sheet supply tray 60. For example, a two-dimensional code, or a concavo-convex shape provided on the outer surface of each of the sheet supply trays 60 may be cited as the identification label. Accordingly, a reader for the two-dimensional code or a switch configured to detect the concavo-convex shape of the sheet supply tray 60 may be cited as the reading device.

Fourth Embodiment

As described above, the paper sheet P may be processed by the pre-coat treatment. When the pre-coat treatment is performed on the paper sheet P, it is needed to fully dry the liquid on the paper sheet P in order to dry the inks, compared to the paper sheet P on which the pre-coat treatment is not performed.

The table stored in a drying-treatment-amount setting portion 82 includes a fifth table T5 and a sixth table T6. The fifth table T5 stores, for the paper sheet P on which the pre-coat treatment is not performed, values representing the heating times corresponding to respective values representing the stack height of the paper sheets P. The sixth table T6 stores, for the paper sheet P on which the pre-coat treatment is performed, values representing the heating times corresponding to respective values representing the stack height of the paper sheets P. A configuration of the fifth table T5 is almost the same as a configuration of the first table T1 shown in FIG. 9, and the a configuration of the sixth table T6 is almost the same as a configuration of the second table T2 shown in FIG. 9.

Figure 12:
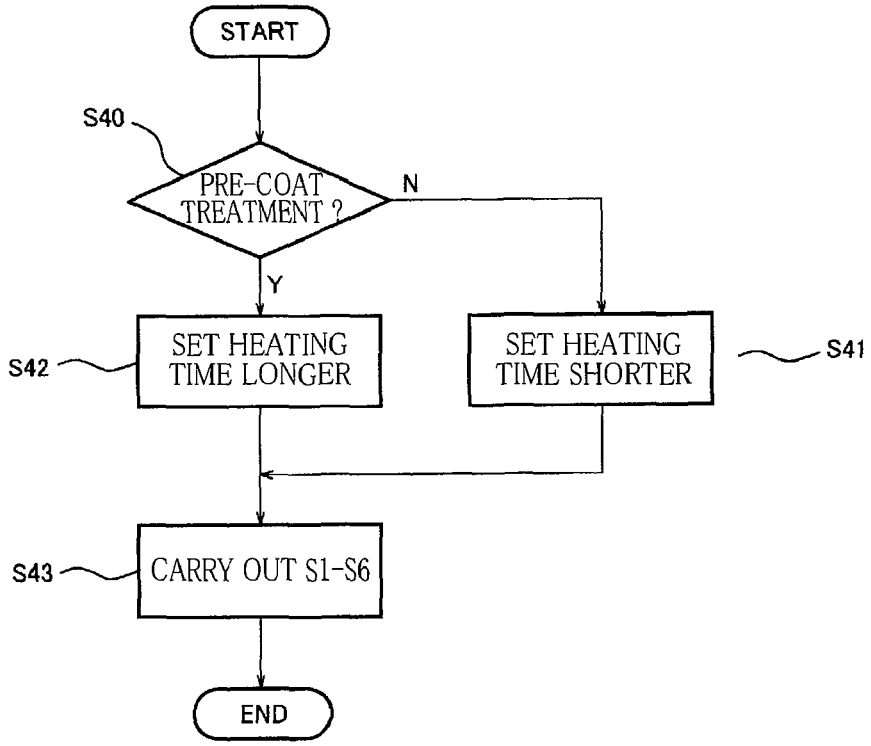
FIG. 12 is a flow chart representing an operation of the controller of a fourth embodiment.

The heating time needs to be long in the case of the paper sheet P on which the pre-coat treatment is performed, compared to the case of the paper sheet P on which the pre-coat treatment is not performed. Accordingly, when the stack height is the same between the case of the paper sheet P on which the pre-coat treatment is performed and the case of the paper sheet P on which the pre-coat treatment is not performed, the value of the heating time according to the sixth table T6 is larger than the value of the heating time according to the fifth table T5. Additionally, in the third table T5, when the value of the stack height N of the paper sheets P is less than the threshold, the heating time may be 0 sec. In this case, the paper sheet P may not be halted at the predetermined position. An operation of the controller 8 is described with reference to FIG. 12 as below.

The parameter discrimination unit 81 determines whether or not the pre-coat treatment is performed on the paper sheet P, based on the print job or the information inputted by the user to the operation panel 12 (step S40). This determination result is transmitted to the control unit 80. In other words, the parameter discrimination unit 81 may be referred to as a recording condition input unit.

When it is determined in the step S40, that the pre-coat treatment is not performed on the paper sheet P, the control unit 80 transmits information that the pre-coat treatment is not performed on the paper sheet P, to the drying-treatment-amount setting portion 82. The drying-treatment-amount setting portion 82 sets the heating time corresponding to a case that the pre-coat treatment is not performed, for the drying mechanism 2, specifically, for the heater 20. That is, the drying-treatment-amount setting portion 82 reads out the heating time from the fifth table T5, and then sets, for the heater 20, the heating time shorter than the heating time in a case that the pre-coat treatment is performed (step S41).

When it is determined in the step S40 that the pre-coat treatment is performed on the paper sheet P, the control unit 80 transmits information that the pre-coat treatment is performed on the paper sheet P, to the drying-treatment-amount setting portion 82. The drying-treatment-amount setting portion 82 sets the heating time corresponding to the case that the pre-coat treatment is performed on the paper sheet P, for the heater 20. That is, the drying-treatment-amount setting portion 82 reads out the heating time from the sixth table T6, and then sets, for the heater 20, the heating time longer than the heating time in the case that the pre-coat treatment is not performed (step S42).

Afterward, the control unit 80 and the drying-treatment-amount setting portion 82 carry out the process from the step S1 to the step S6 (step S43). That is, the heating time is read out from the fifth table T5 or the sixth table T6 according to the stack height of the paper sheets P, and the heater 20 is heated for the read heating time.

When the pre-coat treatment is performed on the paper sheet P, it takes a longer time to fully dry the inks on the paper sheet P, compared to the case that the pre-coat treatment is not performed. Therefore, in the case that the pre-coat treatment is performed, the heating time is set to be longer to fully dry the liquid, specifically, the inks and the treatment liquid on the paper sheet P.

Fifth Embodiment

As described above, the paper sheet P discharged to the space over the sheet discharged tray 11 firstly flies toward the stopper 15 and collides with the stopper 15. Then, the paper sheet P drops onto the bottom plate 11*b* of the sheet discharged tray 11 and is placed on the bottom plate 11*b*. When a speed of the paper sheet P is relatively slow in the discharging toward the sheet discharged tray 11 in a case that the paper sheets P are placed in relatively large numbers on the bottom plate 11*b* so as to form a bundle of said paper sheets P, the paper sheet P moves while rubbing against the top paper sheet P of the bundle. Thus, if a part of the inks which has not fully dried remained on the discharged paper sheet P, the inks would attach to the top paper sheet P. Therefore, when the paper sheets P are placed in relatively large numbers on the bottom plate 11*b*, it is needed that the sheet P is discharged in a speed higher than the case in which the paper sheet P are placed in relatively small numbers on the bottom plate 11*b*.

Figure 13:
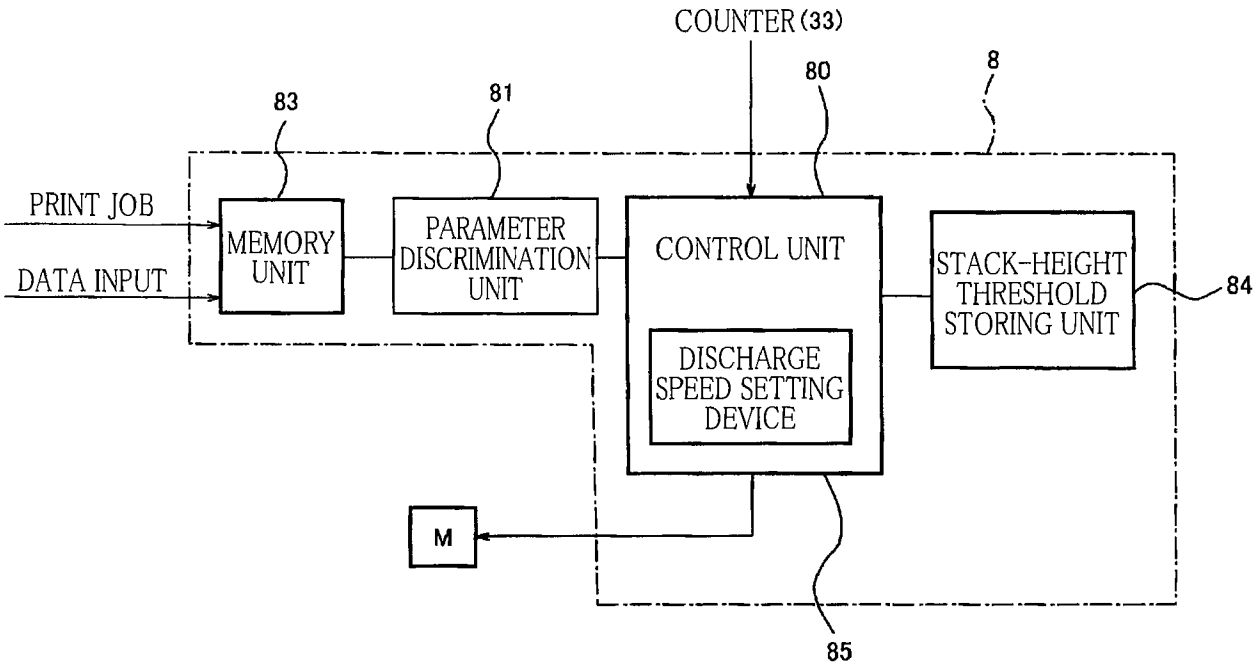
FIG. 13 is a block diagram of configuration of a controller of a fifth embodiment.

As shown in FIG. 13, the controller 8 includes the memory unit 83 configured to temporarily store the print job and data inputted from the user via the operation panel 12, the parameter discrimination unit 81 connected to the memory unit 83, the control unit 80 connected to the parameter discrimination unit 81 and the counter 33, and the stack-height threshold storing unit 84 storing the threshold regarding the stack height of the paper sheets P discharged on the sheet discharged tray 11. The control unit 80 includes a discharging speed setting device 85 configured to apply an electric voltage to the motor M. The higher the voltage applied to the motor M becomes, the faster the motor M rotates. For example, the threshold of the stack height of the paper sheets P stored in the stack-height threshold storing unit 84 is set to 5 cm herein.

The discharging speed setting device 85 stores a table T7 regarding a relation between the value of the stack height of the paper sheets P on the sheet discharged tray 11 and a value of the voltage applied to the motor M. Hereinafter, the voltage applied to the motor M is referred to as a motor voltage. According to the table T7 shown in FIG. 14, when the stack height is equal to or more than 5 cm which is the threshold stored in the stack-height threshold storing unit 84, the value of the motor voltage is set to be larger as the stack height becomes higher.

According to the table T7, when the stack height is less than 5 cm which is the threshold stored in the stack-height threshold storing unit 84, the value of the motor voltage is set to a constant voltage, specifically, 5V. The constant voltage is smaller than the motor voltage in the case in which the stack height of the stack height of the paper sheets P is equal to 5 cm being the threshold. The values of the motor voltage and the stack height according to FIG. 14 are determined for this embodiment and are not limited.

Operation of Controller

Figure 15:
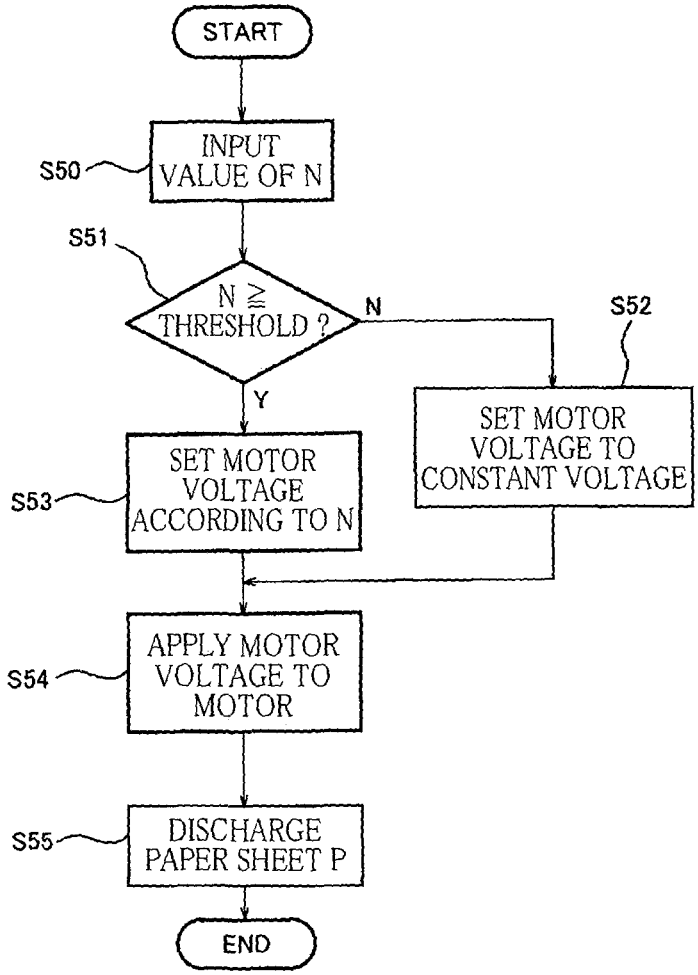
FIG. 15 is a flow chart representing an operation of the controller of a fifth embodiment.

A detailed operation of the controller 8 is described with reference to FIG. 15 as below. When the print job is inputted into the parameter discrimination unit 81 via the memory unit 83, the control unit 80 detects that a stack of paper sheets P on the sheet discharged tray 11 is started. When a value of the stack height N of the paper sheets P stacked on the sheet discharged tray 11 is inputted from the counter 33 (step S50), the control unit 80 reads out the threshold from the stack-height threshold storing unit 84. Next, the control unit 80 determines whether the value of the stack height N of the paper sheets P is equal to or more than the threshold (step S51). When the value of the stack height N of the paper sheets P is less than the threshold, the control unit 80 transmits, to the discharging speed setting device 85, information that the value of the stack height N of the paper sheets P is less than the threshold, and the discharging speed setting device 85 sets the motor voltage to the constant voltage (step S52). The discharging speed setting device 85 applies the motor voltage of the constant voltage to the motor M so as to rotate the motor M (step S54). The paper sheet P flies to the stopper 15 so as to be discharged on the sheet discharged tray 11 (step S55).

When the value of the stack height N of the paper sheets P is equal to or more than the threshold in the step S51, the control unit 80 transmits, to the discharging speed setting device 85, information that the value of the stack height N of the paper sheets P is equal to or more than the threshold, and the discharging speed setting device 85 sets the motor voltage to a voltage according to the value of the stack height N of the paper sheets P (step S53). The discharging speed setting device 85 reads out the value of the motor voltage according to the value of the stack height N of the paper sheets P, from the table T7 stored in the discharging speed setting device 85, and then applies the motor voltage of the read-out value to the motor M (step S54). In this step, the motor voltage is set to become stepwisely larger as the value of the stack height N of the paper sheets P becomes larger.

The paper sheet P flies to the stopper 15 so as to be discharged on the sheet discharged tray 11 (step S55).

In the ink-jet recording apparatus 1 of the fifth embodiment, when the paper sheets P of pieces equal to or more than a threshold are placed on the sheet discharged tray 11, the motor M discharges the paper sheet P in a relatively high speed so as to cause the paper sheet P to collide with the stopper 15 and then drop toward the bottom plate 11*b*. Therefore, the paper sheet P is less likely to move while rubbing against the top paper sheet P of the bundle.

As described above, the discharging speed setting device 85 adjusts the motor voltage applied to the motor M. However, an electric current supplied to the motor M may be adjusted instead of the motor voltage. In the above described fifth embodiment, the ink-jet recording apparatus 1 may comprise the heater 20 or may not comprise the heater 20.

Figure 16A:
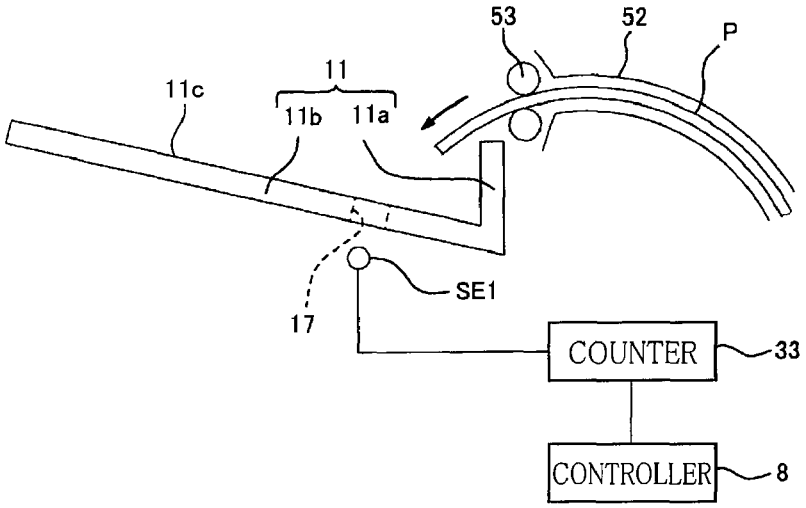
FIGS. 16A and 16B are block diagrams of another constitution of an obtaining device according to the present invention.

Another constitution of an obtaining device according to the present invention is illustrated for the sheet discharged tray 11. This obtaining device is constituted, as shown in FIG. 16A, by disposing a through hole 17 in the bottom plate 11*b* of the sheet discharged tray 11 and disposing a light sensor SE1 emitting a light upward below the through hole 17. The light sensor SE1 is connected to the counter 33, and the counter 33 is connected to the controller 8. Since the controller 8 controls an operation of the liquid ejection head 4, the controller 8 can determine a finish of the ejection of the inks on the paper sheet P.

When no paper sheet P exists on the sheet discharged tray 11, the light from the light sensor SE1 enters into the through hole 17 and is not reflected. Therefore, the light is not incident on the light sensor SE1. When the paper sheet P exists on the sheet discharged tray 11 because of the discharging of the paper sheet P, the light emitted from the light sensor SE1 enters into the through hole 17 and is then reflected by the paper sheet P. Therefore, the light is incident on the light sensor SE1. When the light sensor SE1 detects that the light has been incident, the light sensor SE1 sends information that the light is detected, to the counter 33. The counter 33 determines, from this information, that the paper sheet P is stacked on the sheet discharged tray 11. Afterward, the counter 33 counts the number of the paper sheets P having been discharged on the sheet discharged tray 11 by obtaining, from the controller 8, information that the inks are ejected onto the paper sheet P. The counter 33 has a thickness of a piece of paper sheet P, and therefore a height of the stack height of the paper sheets P can be calculated by multiplying the thickness of the piece of paper sheet P by the number of the paper sheets P counted by the counter 33.

Figure 16B:
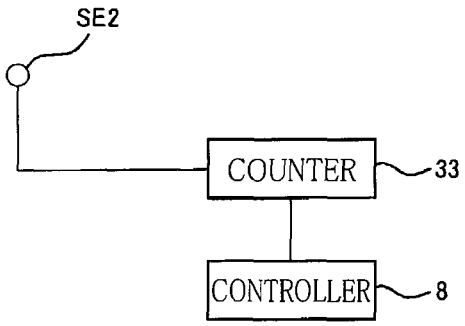

The obtaining device may have another constitution. The obtaining device may be constituted, as shown in FIGS. 1 and 16B, by disposing a sheet passing sensor SE2 in the upstream region of the liquid ejection heads 4 in the sheet conveying direction and connecting the sheet passing sensor SE2 to the counter 33. The sheet passing sensor SE2 outputs a signal to the counter 33 every time when the paper sheet P passes by the sheet passing sensor SE2, whereby the number of the paper sheets P having been discharged on the sheet discharged tray 11 can be counted. The stack height of the paper sheets P can be calculated by multiplying the thickness of the paper sheet P by the number of the paper sheets P counted by the counter 33.

Figure 17A:
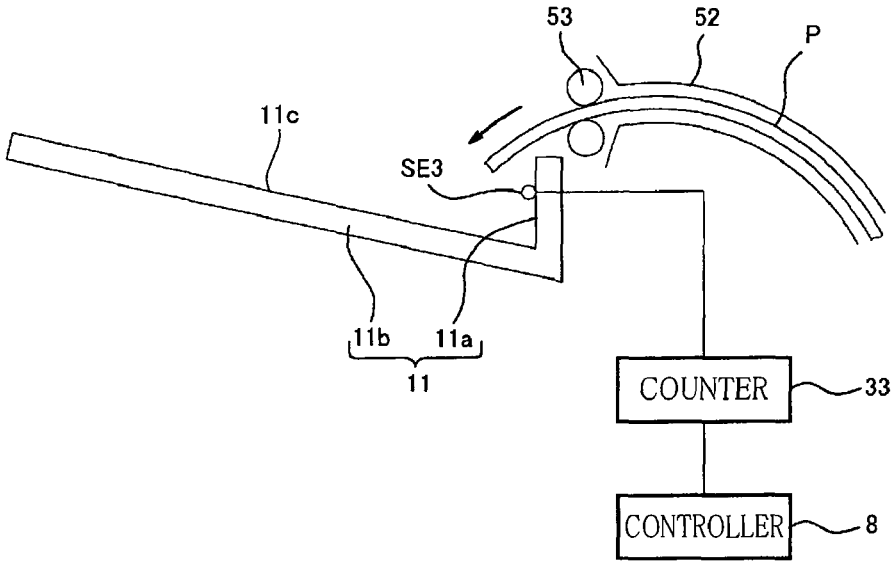
FIGS. 17A and 17B are block diagrams of yet another constitution of the obtaining device according to the present invention.

The obtaining device may have another constitution. The obtaining device may be constituted, as shown in FIG. 17A, by disposing a height position detecting sensor SE3 inside the vertical wall 11*a* of the sheet discharged tray 11 and connecting the height position detecting sensor SE3 to the counter 33. When the height position detecting sensor SE3 detects that a height of the paper sheets P stacked on the bottom plate 11*b* is taller than a set height, the height position detecting sensor SE3 outputs information that the height of the paper sheets P stacked on the bottom plate 11*b* is taller than the set height, to the counter 33. Afterward, the counter 33 counts the number of the paper sheets P having been discharged on the sheet discharged tray 11 by obtaining, from the controller 8, information that the inks are ejected onto the paper sheet P. The stack height of the paper sheets P can be calculated by multiplying the thickness of the paper sheet P by the number of the paper sheets P having been discharged on the sheet discharged tray 11 and adding the result of the multiplying to the aforementioned set height detected by the height position detecting sensor SE3.

Figure 17B:
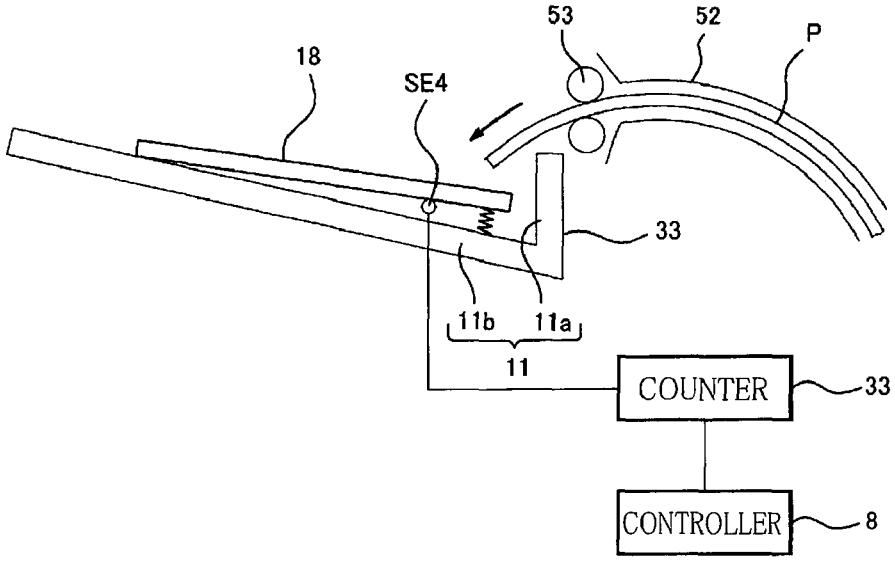

The obtaining device may have another constitution shown in FIG. 17B. In this obtaining device, a receiving plate 18 is rotatably supported at one edge thereof to the bottom plate 11*b* of the sheet discharged tray 11, and the receiving plate 18 is pushed upward at the other edge thereof by a spring 19. The receiving plate 18 is provided with a displacement detecting sensor SE4 configured to detect an up-down displacement amount of the receiving plate 18. The displacement detecting sensor SE4 is connected to the counter 33. As the printed paper sheets P are accumulated on the bottom plate 11*b*, the receiving plate 18 lowers due to the load of the paper sheets P. The displacement detecting sensor SE4 obtains a lowering amount of the receiving plate 18 and outputs the lowering amount to the counter 33. The counter 33 stores a table regarding a relation between the value of the stack height of the paper sheets P and a value of the lowering amount. Therefore, the counter 33 can obtain the stack height of the paper sheets P based on the lowering amount of the receiving plate 18 obtained by the displacement detecting sensor SE4. Incidentally, a top face of the receiving plate 18 is an example of a sheet placed face.

In the aforementioned embodiments, a paper sheet P is illustrated as an example of a recording medium. Alternatively, a film sheet, a label sheet, and so on may be cited as a recording medium.

Additionally, in the aforementioned embodiments, the control unit 80 includes the drying-treatment-amount setting portion 82 (refer to FIG. 6) or the discharging speed setting device 85 (refer to FIG. 13). Alternatively, the control unit 80 and the drying-treatment-amount setting portion 82 may be provided separately and connected to each other, or the control unit 80 and the discharging speed setting device 85 may be provided separately and connected to each other.

Figure 18:
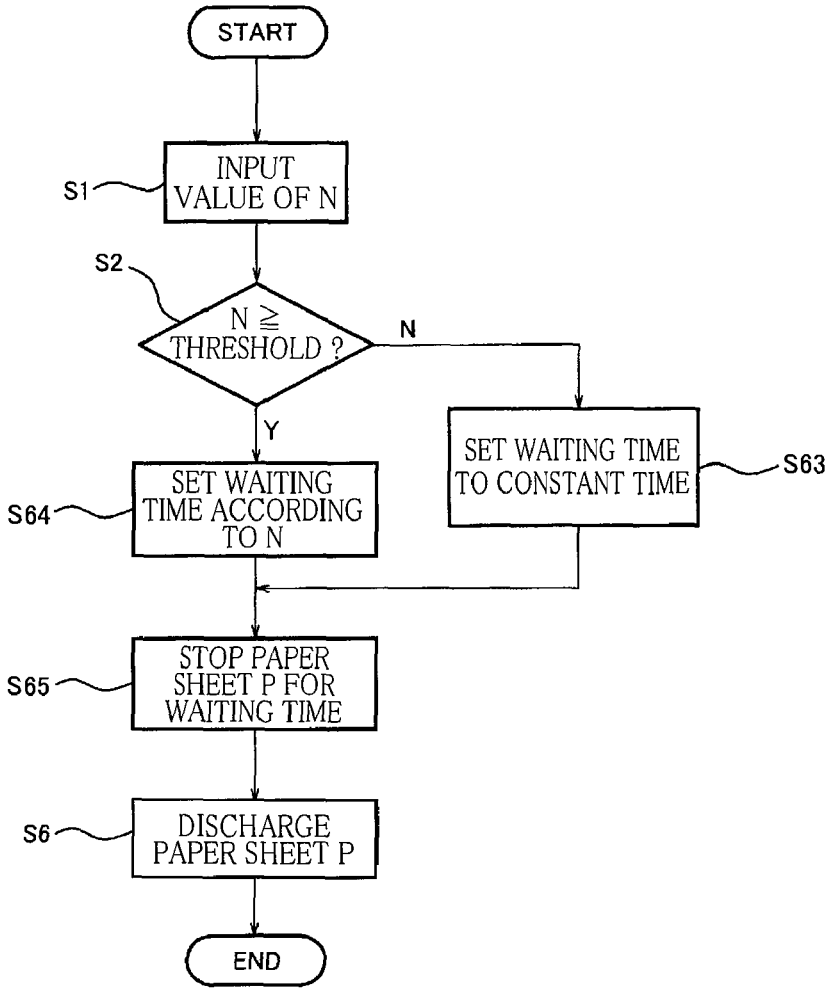
FIG. 18 is a flow chart representing an operation of a controller of a modified embodiment of the first embodiment.

In the aforementioned embodiments, the heating time for the paper sheet P is cited, as one example of the drying treatment amount. Alternatively, a heating temperature may be cited, or a waiting time (natural drying time) may be cited for the paper sheet P in a state in which the heater 20 is not used. This aspect is illustrated as a modified embodiment of the first embodiment, in FIG. 18. As shown in FIG. 18, in a case that the waiting time of the paper sheet P is cited as the drying treatment amount, when the stack height N is equal to or more than the threshold, that is, when the inks on the paper sheet P need to be fully dried, the drying treatment amount setting device 82 sets a time according to the stack height N to the waiting time (step S64). On the other hand, when the stack height N is less than the threshold, the drying treatment amount setting device 82 sets a constant time to the waiting time (step S63). The constant time is shorter than the waiting time at the time when the stack height N is equal to or more than the threshold. Then, the controller 8 controls the motor M in order that the paper sheet P halts for the set waiting time (step S65). In this case, the drying-treatment-amount setting portion 82 constitutes an example of a controller. Additionally, when the value of the stack height N of the paper sheets P is less than the threshold, the waiting time may be 0 sec. In this case, the paper sheet P is not halted at the predetermined position. Moreover, for example, when the degree of drying is increased in a case in which a heater 20 is used, a temperature of the heater may be raised or a volume of an air flow blown from the heater may be increased, while the waiting time is set to be constant regardless the number of the paper sheet P stacked on the sheet discharged tray. Moreover, the degree of drying may be set by a combination of the temperature of the heater and the volume of the air flow.

In the aforementioned embodiments, the controller 8 may be constituted by a single CPU. Alternatively, the controller 8 may be constituted by a plurality of CPUs, an ASIC (application specific integrated circuit), or a combination of a CPU and an ASIC.

What is claimed is:

1. A liquid ejection apparatus comprising:

a liquid ejection head configured to eject a liquid onto a recording medium so as to record an image on the recording medium;

a drying device configured to dry the recording medium on which the image has been recorded by the liquid ejection head;

a sheet discharged tray including a sheet placed face on which a plurality of recording media on which the image has been recorded by the liquid ejection head are placed and stacked;

a sheet discharging device configured to discharge the recording medium on which the image has been recorded by the liquid ejection head to a space over the sheet placed face of the sheet discharged tray in a sheets-stacked direction in which the plurality of recording media are stacked;

a stopper configured to cause the recording medium discharged by the sheet discharging device to the space over the sheet placed face in the sheets-stacking direction to collide with the stopper and to drop toward the sheet placed face;

an obtaining device configured to obtain a height of the plurality of recording media stacked on the sheet placed face of the sheet discharged tray; and a controller configured to control the drying device so that a degree of drying of the recording medium on which the image has been recorded becomes larger in a case in which the height obtained by the obtaining device is equal to or more than a set specific value, than in a case in which the height is less than the set specific value.

2. The liquid ejection apparatus according to claim 1, wherein the drying device comprises a heater.

3. The liquid ejection apparatus according to claim 1, wherein the controller is configured to control the drying device so that, as the height obtained by the obtaining device becomes higher, the degree of drying of the recording medium becomes larger, in the case in which the height is equal to or more than the set specific value.

4. The liquid ejection apparatus according to claim 1, wherein the controller is configured to control the drying device so that, as the height obtained by the obtaining device becomes higher, the degree of drying of the recording medium stepwisely becomes larger, in the case in which the height is equal to or more than the set specific value.

5. The liquid ejection apparatus according to claim 1, wherein the controller is configured to set a waiting time in which the recording medium on which the image has been recorded is stopped in the drying device;

wherein the controller is configured to set the waiting time so that the waiting time becomes longer in the case in which the height obtained by the obtaining device is equal to or more than the set specific value, than in the case in which the height is less than the set specific value; and wherein the controller is configured to control the drying device to stop the recording medium on which the image has been recorded therein for the set waiting time and dry the recording medium.

6. The liquid ejection apparatus according to claim 1, wherein the drying device comprises a heater for heating the recording medium on which the image has been recorded; and wherein the controller is configured to control the drying device so that the drying device performs at least one of making a heating time of the heater become longer and making a heating temperature of the heater become higher in the case in which the height obtained by the obtaining device is equal to or more than the set specific value, compared to in the case in which the height is less than the set specific value.

7. The liquid ejection apparatus according to claim 1, wherein the controller is configured to obtain information indicating whether the image has been recorded on both sides of the recording medium or only on one side of the recording medium; and wherein the controller is configured to control the drying device so that the degree of drying of the recording medium on which the image has been recorded becomes larger in a case in which the image has been recorded on the both sides of the recording medium, than in a case in which the image has been recorded only on the one side of the recording medium.

8. The liquid ejection apparatus according to claim 1, wherein the controller is configured to obtain information relating to an infiltration characteristic of the liquid into the recording medium on which the image has been recorded; and wherein the controller is configured to control the drying device, on the basis of the information relating to the infiltration characteristic, so that, as the liquid is harder to infiltrate into the recording medium on which the image has been recorded, the degree of drying of the recording medium on which the image has been recorded becomes larger.

9. The liquid ejection apparatus according to claim 1, wherein the controller is configured to obtain information indicating whether or not a pre-coat treatment is performed on the recording medium on which the image has been recorded; and wherein the controller is configured to control the drying device, on the basis of the information indicating whether or not a pre-coat treatment is performed, so that the degree of drying of the recording medium on which the image has been recorded becomes larger in a case in which the pre-coat treatment is performed on the recording medium on the image has been recorded, than in a case in which the pre-coat treatment is not performed on the recording medium on the image has been recorded.

10. A drying method of a liquid ejection apparatus including a liquid ejection head configured to eject a liquid onto a recording medium so as to record an image on the recording medium, a drying device configured to dry the recording medium on which the image has been recorded by the liquid ejection head, a sheet discharged tray having a sheet placed face on which a plurality of recording media on which the image has been recorded by the liquid ejection head are stacked and placed, a sheet discharging device configured to discharge the recording medium on which the image has been recorded by the liquid ejection head to a space over the sheet placed face of the sheet discharged tray in a sheets-stacked direction in which the plurality of recording media are stacked, and a stopper configured to cause the recording medium discharged by the sheet discharging device to the space over the sheet placed face in the sheets-stacking direction to collide with the stopper and to drop toward the sheet placed face, the drying method comprising the steps of:

obtaining a height of the plurality of recording media stacked on the sheet placed face of the sheet discharged tray; and controlling the drying device so that a degree of drying of the recording medium on which the image has been recorded becomes larger in a case in which the obtained height is equal to or more than a set specific value, than in a case in which the obtained height is less than the set specific value.

* * * * *